US006055714A

United States Patent [19]

Sproul

[11] Patent Number: 6,055,714

[45] Date of Patent: May 2, 2000

[54] METHOD OF RENEWING DECORATIVE TASSELS

[76] Inventor: Ted K. Sproul, 1188 Wasatch Downs, South Jordan, Utah 84095

[21] Appl. No.: 09/163,504

[22] Filed: Sep. 30, 1998

[51] Int. Cl.[7] ..... B68F 1/00

[52] U.S. Cl. ..... 29/402.21; 24/715.5; 28/147

[58] Field of Search ..... 29/402.21, 402.19, 29/447; 24/715.5, 715.7; 28/147; 69/21

[56] References Cited

U.S. PATENT DOCUMENTS

| | | | |
|---|---|---|---|
| 761,963 | 6/1904 | Hiller . | |
| 5,299,719 | 4/1994 | Newgas | 28/147 X |
| 5,619,778 | 4/1997 | Sloot | 24/715.4 |

*Primary Examiner*—S. Thomas Hughes
*Assistant Examiner*—Eric Compton
*Attorney, Agent, or Firm*—Mallinckrodt & Mallinckrodt

[57] ABSTRACT

A method of renewing decorative tassels after they have become unsightly from wearing of an item to which they are attached, particularly shoes wherein the one or more tassels is made up of strands of moisture-absorbent leather or synthetic leather extending integrally side-by-side from a stem base attached to the shoe. The method comprises encasing the tassel, as straightened and rearranged, in a tube length of heat-shrink material; applying moisture to the strands of the tassel; heating the heat-shrink tube along its length to shrink it tightly against the tassel as straightened and rearranged, so as to press it into renewed condition; and removing the shrunken tube from the renewed tassel substantially without disturbing the straightened and rearranged strands thereof.

7 Claims, 1 Drawing Sheet

METHOD OF RENEWING DECORATIVE TASSELS

BACKGROUND OF THE INVENTION

1. Field

The invention is concerned with methods for placing and holding the component strands of decorative tassels into their original conditions after displacement by use of the items to which they are connected.

2. State of the Art

It has become fashionable for both men and women to wear shoes equipped with tassels, which are normally made up of rectilinear strands of leather arranged side-by-side in substantially cylindrical formation. When such shoes are new and boxed or are otherwise placed in stores for display, the strands of such tassels are straight and neatly bunched together. However, normal use of the shoes carrying the tassels usually disarranges the component strands in an unsightly manner. Heretofore, there has been no way for the wearer to effectively renew the tassels or to have them renewed.

The closest approach has been a proposal for shoe accessory clips having a pair of overlapped, toothed jaws normally held together by spring action and operable by the user for receiving a tassel between the spring pressed jaws. It is proposed that merely clipping the device onto an unruly tassel and leaving the receiving jaws of the clip under spring pressure overnight will "tame" the unsightly tassel.

SUMMARY OF THE INVENTION

In the making of the present invention, it was a principal object to provide a method whereby the user, himself or herself or a shoe repair shop, can renew shoe-trimming tassels easily, quickly, economically, and above all, effectively.

A feature of the invention in the achievement of this objective is the use of a tube of heat-shrink material, such as a thermoplastic, being typically about one-half inch in diameter, dependent upon the size and make of the tassel, and of length sufficient to substantially comprehend the length of the tassel or preferably somewhat longer for a purpose to be made clear.

The heat-shrink tube, normally commercially available, is applied to an unruly or unsightly tassel by pushing or pulling the tube over the tassel as straightened by the user after the applying of moisture to the strands of the tassel to make them flexible. While moisturizing is preferably accomplished by spraying a water mist over the tassels before installing the tube thereon, the moisturizing could be done in various ways before or after placing the tubing thereon. For protecting the shoe during this and subsequent procedures, it is preferred to cover the front, i.e., vamp portion, of the shoe with a dry towel and to lay the tassel or tassels on the upper surface of the towel for the moisturizing operation. The moisture is absorbed by the leather or other moisture absorbent strands, which makes them flexible for rearrangement and enables them to be easily pressed into normal condition by application of heat to the heat-shrink tube.

In accordance with the invention, the heat-shrink tube is of length adequate to receive and substantially cover the side-by-side strands of the tassel as straightened, but is preferably somewhat longer than the strands so as to provide a graspable tab end portion which can be pressed closed by the user prior to or during the applying of heat to the heat-shrink tube.

Although heat can be applied in various ways, the best way presently contemplated is by directing hot air discharged from a usual commercial hair dryer onto the exterior surface of the tube-encased tassel for several minutes, during which time the tube will shrink and press against the straightened strands of the tassel during drying of the moisture therefrom. If this procedure is done in the evening, it is preferable to leave the tube in place overnight and to remove the tube in the morning by grasping the pressed and closed end thereof and pulling the tube off of the renewed tassel. Controlling the amount and temperature of the heat is important as will appear hereinafter.

THE DRAWINGS

The best mode presently contemplated for carrying out the invention is illustrated, with respect to shoe-trim tassels, in the accompanying drawings, in which:

FIG. 1 represents a pictorial view of a usual casual or sport shoe equipped with a pair of typical, shoe-trimming tassels, the view looking toward the vamp portion of the shoe after the shoe has been worn and the component strands of the respective tassels have been disarranged in an unsightly manner;

FIG. 2, an enlarged fragmentary view of one of the pair of tassels of the shoe of FIG. 1;

FIG. 3, a view corresponding to that of FIG. 2 after the bunched but disarranged strands have been rearranged for renewal and tucked into an appropriate length and diameter of heat-shrink tube, leaving an open, tab-forming, end portion of sufficient length for pressing by the user into a grasping and pulling tab to facilitate removal of the tube after heating of the tube encasing the tassel;

FIG. 4, a view corresponding to that of FIG. 3 after the strands have been moisturized and heat has been applied to the heat-shrink tube, the open end portion of the heat-shrink tube having been pressed to form a grasping tab; and FIG. 5, a view corresponding to that of FIG. 4 after pressing of the encased tassel to renewed condition and after removal of the heat-shrink tube.

DETAILED DESCRIPTION OF THE ILLUSTRATED EMBODIMENT

Figure 1:
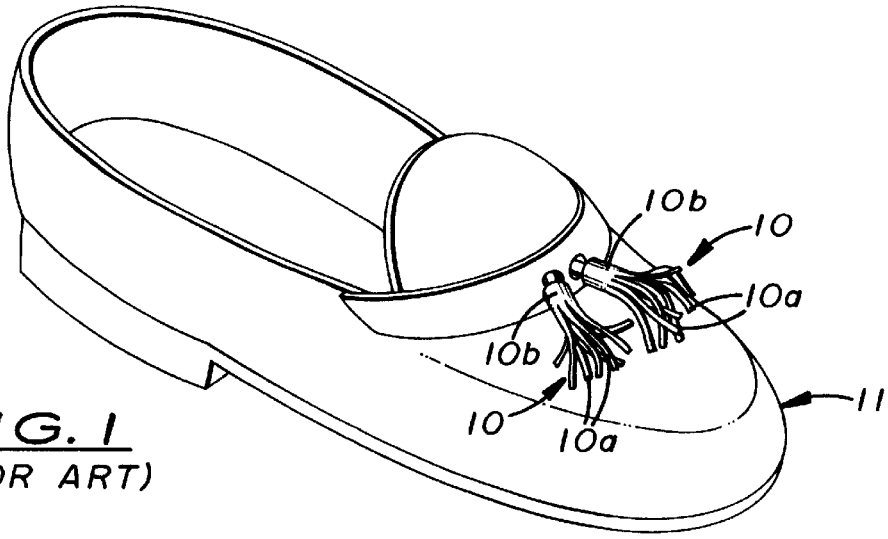
FIG. 1 (PRIOR ART)
Figure 2:
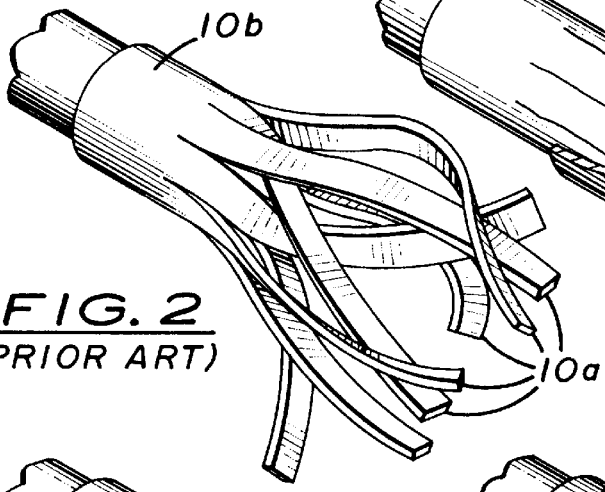
FIG. 2 (PRIOR ART)

FIG. 1 of the drawing shows typical, paired tassels 10, 10 on one shoe 11 of a pair of shoes, each tassel being cut from leather or a leather substitute into strands 10*a* extending integrally from a base stem portion 10*b* to which they are attached in various ways with or without additional tassel structure (not shown) depending upon the particular make of the shoe and the tassels thereof. As shown, the strands 10*a* have become disarranged and bent out of their original, side-by-side, cylindrical tassel shape resulting from use of the shoe 11 to which they are attached as decorative trim.

Figure 5:
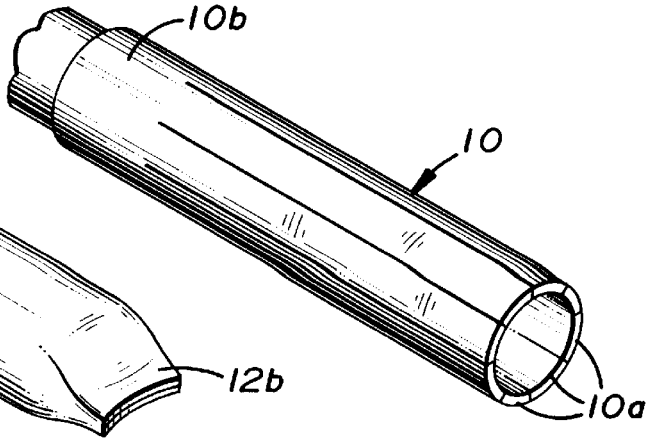

It should be realized that the shoe 11 and that each tassel 10, with its strands 10*a* extending from its base stem 10*b*, whether such strands are untidily disarranged as shown in FIG. 1 or are in their original neat, side-by-side, cylindrical arrangement shown in the renewed form of FIG. 5, are structurally old and part of the prior art and that it is the method constituting the procedural steps set forth and claimed hereinafter that is the invention to be protected by patent.

Broadly speaking, the method comprises the steps of confining the strands of a decorative tassel within a substantially equivalent tube length (although preferably a somewhat longer tube length) of a heat-shrink tube which, when heated and shrunk, is about the size of the original tassel, the strands of such tassel being moistened prior to the application of heat to the outside of the tube.

Figure 3:
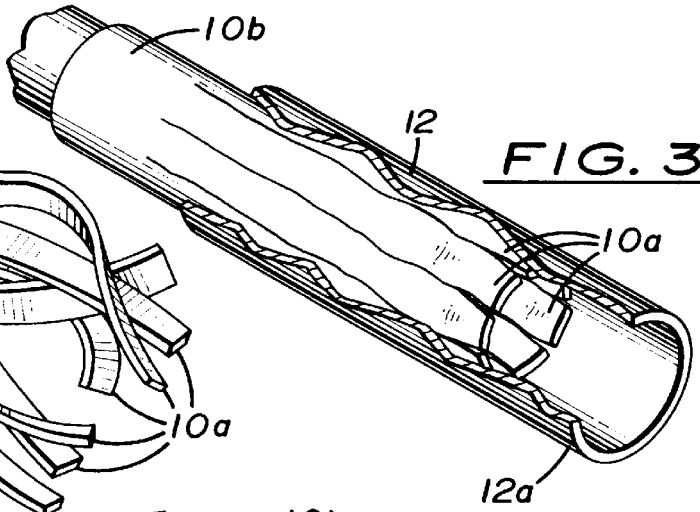

When the item to which the tassel is attached is a shoe, as is the shoe 11 of FIG. 1 with its pair of tassels 10, 10, the strands 10*a* of each tassel are typically cut longitudinally from an open end of a preferably cylindrically tubular base stem 10*b* so as to extend integrally therefrom and side-by-side as shown in FIG. 5, but such shoe tassels are variously made depending upon the manufacturer. In using the method of the invention on a tassel of a shoe, such tassel is encased in a tube, here 12 of heat-shrink material, such as a heat-shrink, thermoplastic material which is commercially available from various suppliers. The strands of the tassel may either be rearranged for renewal as shown in FIG. 3 before tucking it in such tube through one of the open ends thereof, or may be straightened and rearranged by the user working through an open end of the tube prior to application of heat to such tube. In either instance, the strands of the tassel will be moistened by spraying them with a mist of water prior to heating the applied heat-shrink tube.

Figure 4:
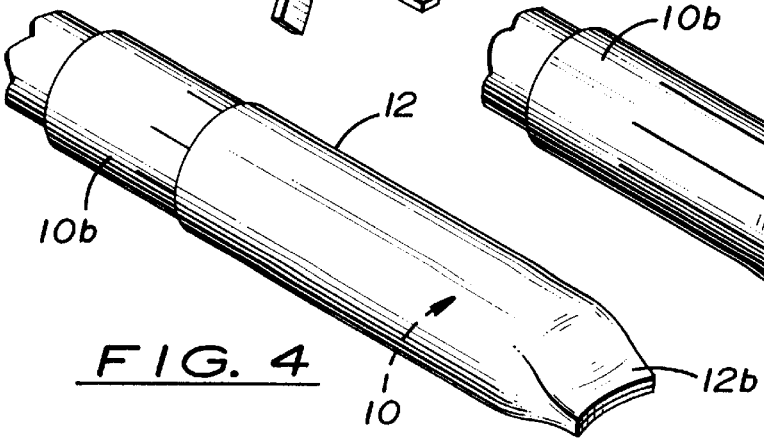

The applied tube preferably has sufficient excess length, as at 12*a*, FIG. 3, to provide for the user squeezing such excess length together at the free ends of the strands to close the open end of the tube thereof during or before application of heat to the tube externally thereof and to provide a flattened tab end for the tube, see 12*b*, FIG. 4, which may be grasped by the user following renewal of the tassel to facilitate pulling of the tube from the renewed tassel substantially without disturbing the renewed tassel.

Heating of the tube is preferably accomplished by directing a blast of heated air against and along its outside as by means of a usual commercial hair dryer. It is important that either the heat source or the encased tassel, or both, be kept moving so as not to concentrate the heat in any one place and that the source of heat be low intensity (such as the previously mentioned commercial hair dryer, or a hot air gun). When heated properly, the heat-shrink tube will be substantially uniformly reduced in diameter until pressed against the encased tassel and reduction in diameter essentially stops, at which point heating should be discontinued. If this takes place at night, the tube may be left on the tassel overnight, but in any event they should be left in place long enough for the moistened strands of the tassel to effectively dry, usually about four hours for shoe tassels adequately wet by water mist sprayed thereon.

Although it is convenient and preferable to provide excess length, as at 12*a*, FIG. 3, for the heat-shrinkable, tassel encasing tube 12, so as to provide for forming the user-graspable tab 12*b* to facilitate removal of the tube from the renewed tassel 10 in FIG. 5, as well as to use tubing which is transparent so as to be able to view the pressing of the tassel as that takes place, neither of these features is necessary for effective workability of the method.

In the directing of hot air against a heat-shrink tube encompassing the leather tassels of a shoe, as from a usual hair dryer, or against other tassels being renewed, it is important that the heated air is moved back and forth along the length of the heat-shrink tube so as not to be concentrated at any one place and that the heated air not be so hot as to destroy the characteristics of the heat-shrink tube. Industrial hot air guns can be used to hasten the end result if kept within the heat range specified for the heat-shrink tube used.

While the method is primarily intended for renewing decorative leather tassels of shoes worn by men, women, or children, it is applicable to the renewing of moisture absorbent tassels in general.

Whereas this invention is here illustrated and described with reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A method of placing moisture-absorbent strands of a decorative tassel into renewed condition after they have become disarranged by use of items to which they are attached, comprising applying moisture to said strands; encasing the strands in a tube of heat-shrinkable material in substantially the desired renewal arrangement; applying heat to the resulting encased tassel in its said renewal arrangement to shrink said tube about the rearranged strands of the tassel; and removing the heat shrunken tube after substantial drying of the moistened strands substantially without disturbing the heat-shrink, tube-pressed, renewed arrangement of said strands.

2. A method in accordance with claim 1, wherein the length of the heat-shrink tube exceeds the lengths of the strands of the tassel sufficiently to provide for the user pressing the excess length of said tube into a graspable tab; and further comprising pressing such excess length of said tube to provide said graspable tab for use in pulling the heat-shrunken tube from the renewed tassel.

3. A method in accordance with claim 2, wherein the heat-shrink tube is transparent to visually facilitate rearrangement of the tassel strands encased by the tube.

4. A method in accordance with claim 1, wherein the heat-shrink tube is transparent to visually facilitate rearrangement of the tassel strands encased by the tube.

5. A method in accordance with claim 1, wherein the decorative tassels are connected to a shoe and are made up of moisture absorbent strands of leather-like material.

6. A method in accordance with claim 5, further comprising placing a towel over the shoe; placing the tassels to be renewed on top of the towel and spraying the tassels, with water mist until flexible; straightening the tassels and placing the tassels in respective heat-shrink tubes; directing heated air onto and along the heat-shrink tubes until said tubes are shrunken and are pressed against the respective tassels as straightened and are left in place until the tassels are substantially dry; and removing the heat-shrink tubes from the respective tassels as renewed substantially without disarranging the renewed tassels.

7. A method in accordance with claim 6, wherein the heated air is applied substantially evenly along the lengths of the heat-shrink tubes at a temperature and within a time substantially no greater than will cause such heat-shrink tubes to shrink and press against the encompassed tassels.

* * * * *